US006050058A

United States Patent [19]

Loreto et al.

[11] Patent Number: 6,050,058

[45] Date of Patent: Apr. 18, 2000

[54] METHOD FOR FORMING A PACKAGING FOR A PLURALITY OF CONTAINERS WHICH IS EASILY OPENED

[75] Inventors: Vittorino Loreto, Siracusa; Corrado Loreto, Avola, both of Italy

[73] Assignee: Cielle Di Loreto Tommaso, Mililli, Italy

[21] Appl. No.: 09/091,241

[22] PCT Filed: Dec. 11, 1996

[86] PCT No.: PCT/EP96/05545

§ 371 Date: Jun. 12, 1998

§ 102(e) Date: Jun. 12, 1998

[87] PCT Pub. No.: WO97/21608

PCT Pub. Date: Jun. 19, 1997

[30] Foreign Application Priority Data

Dec. 12, 1995 [IT] Italy ..... MI95A2595

[51] Int. Cl.[7] ..... B65B 61/02

[52] U.S. Cl. ..... 53/411; 53/463; 53/442; 53/131.1; 206/432; 229/89

[58] Field of Search ..... 53/463, 389.1, 53/442, 410, 411, 389.3, 131.1; 156/289, 308.4; 206/432, 427; 229/87.05, 89

[56] References Cited

U.S. PATENT DOCUMENTS

| | | | |
|---|---|---|---|
| 3,834,525 | 9/1974 | Morgese et al. | 206/432 |
| 4,382,506 | 5/1983 | Chaussadas | 206/432 |
| 4,535,587 | 8/1985 | Rias | 53/442 |
| 5,129,518 | 7/1992 | Tanaka et al. | 206/497 |
| 5,858,155 | 1/1999 | Hill et al. | 156/289 |
| 5,868,801 | 2/1999 | Lindh et al. | 156/289 |

FOREIGN PATENT DOCUMENTS

| | | |
|---|---|---|
| WO 93/23310 | 11/1993 | WIPO . |
| WO 95/07848 | 3/1995 | WIPO . |

*Primary Examiner*—Peter Vo
*Assistant Examiner*—Matthew Luby
*Attorney, Agent, or Firm*—Young & Thompson

[57] ABSTRACT

The method for forming a packaging (1) for a plurality of containers (2) arranged in lines and rows involves wrapping the group of containers with a section of heat-sealable plastic film (3), the two end flaps of which overlap so as to be able to be heat-sealed with one another. Pre-cut lines (5), parallel to the direction in which the film itself extends, are formed beforehand in the film. The pre-cut lines are positioned at a distance from one another and, in the finished packaging, each pre-cut line is arranged between two adjacent rows of containers. One side of the film used is provided, in the position where a longitudinal pre-cut lines is already present or is to be formed, with a strip-shaped area which is not heat-sealable when it comes into contact with the film itself. The width of the strips which are not heat-sealable is chosen so as to cover the maximum overlapping imprecision due to the packaging machines.

6 Claims, 2 Drawing Sheets

METHOD FOR FORMING A PACKAGING FOR A PLURALITY OF CONTAINERS WHICH IS EASILY OPENED

FIELD OF THE INVENTION

The present invention relates to a method for packaging a plurality of containers arranged in one or more lines and one or more rows, the set of containers (formed by at least two containers) being wrapped in plastic film which firmly keeps the containers for storage and transportation, the packaging thus obtained being able to be opened manually.

BACKGROUND OF THE INVENTION

Packaging of the aforementioned type which contain a certain number of containers such as, for example, bottles (for water or other beverages), cans (for beer or other beverages or conserves), paper or cardboard containers (for milk, sugar, rice, pasta and similar products) are well known. These containers are arranged alongside one another in an ordered manner, in a certain number of lines and rows (the terms "lines" and "rows" obviously being interchangeable) and then wrapped in a sheet of plastic obtained from a film in the form of a continuous strip wound up in reels, so as to obtain a packaging which has an overall parallelepiped shape. The packaging may enclose a minimum of two products, while the maximum number thereof will in practice depend on the overall dimensions and weight of the packaging. In the case of bottles of water for example, said bottles are usually sold to the public in the form of packs of six bottles ordered in an arrangement of two lines and three rows, so that each pack contains three pairs of bottles arranged side by side. However, it may happen that a purchaser wishes to buy a certain number of bottles less than the number contained in the pack (for example only one pair of bottles). In order to do so, the purchaser is obliged to break the plastic film with his/her hands, which is not only difficult, but also normally upsets the correct arrangement of the remaining bottles inside the packaging. Similarly, after having acquired the whole packaging, if one wishes to remove from it a bottle, one is again obliged to break the plastic film with the result that the remaining bottles, or at least some of them, are no longer retained in position and therefore no longer form a firm packaging.

It is known of a packaging for bottles having pre-cut lines (i.e. lines along which it is possible to easily perform breakage of the plastic film using one's hands) which are of limited length and formed in the plastic film and which affect, however, only part of the top side of the packaging along respective planes lying between two adjacent rows of bottles. This solution, however, does not overcome the drawbacks mentioned above since the removal of one bottle or a pair of bottles from the packaging remains a somewhat difficult operation and still involves free breakage of the part of the plastic film which is not pre-cut, resulting in the possibility that all or some of the other bottles inside the packaging may be freed.

The method for obtaining this packaging having the limited pre-cut lines described above consists substantially in wrapping in a conventional manner the set of six bottles to be packaged, using a section of plastic film of suitable length, normally polyethylene of the heat-shrinkable type, the section of film surrounding entirely the top and bottom surfaces and the two side surfaces (those comprised of three bottles). The assembly thus obtained is then placed in a conventional oven of the type used for causing shrinkage of the film following heating thereof, thus resulting in a conventional packaging. At this point, the relevant limited pre-cut lines are formed only on the top surface of the packaging, forming in the plastic film a respective series of suitably positioned incisions. As already mentioned, these limited pre-cut lines are formed over only a part of the width of the top surface of the packaging.

It is also known from European Patent Application EP-A-0717712 of a packaging for bottles in which pre-cut lines are formed along the entire perimeter of the packaging and lie in parallel vertical planes positioned between the various pairs of bottles.

The most economical method for achieving this result consists in providing beforehand in the plastic film intended to form the packaging for bottles a series of longitudinal and parallel pre-cut lines so that, when the film is cut into sections of suitable length for forming the packaging for the bottles, a continuous pre-cut line is formed between adjacent pairs of bottles. In this way removal of a pair of bottles is substantially facilitated, while the remaining bottles remain correctly packaged.

It has been noted, however, that such a solution, which theoretically appears to be the best solution for the problem, in practice has a serious drawback due to the fact that, in order to form the packaging, the section of plastic film which surrounds the bottles must be overlapped over a distance more or less equal to the width of the base of the packaging, so as to be able to carry out heat-sealing of the two overlapping flaps of the section of film. However, the machines which perform this operation are not currently able to ensure that overlapping of two end flaps of the section of plastic film is performed so as to overlap precisely the corresponding end of each pre-cut line, which in fact normally turn out to be offset (by even more than 1 cm) with respect to one another. This means that, when one wishes to separate a pair of bottles from the packaging thus obtained, the film at the bottom of the packaging still breaks in an irregular manner, since the breakage in the zone underneath the bottles, where overlapping of the film is performed, does not follow the pre-cut lines, with the result that the remaining bottles may not be retained as a firm packaging.

SUMMARY OF THE INVENTION

The object of the present invention is to provide a method for producing a packaging of the type described above, making it possible to obtain a packaging without the aforementioned drawbacks.

These and other objects which will be obvious to a person skilled in the art are achieved by the packaging method according to the present invention, characterised in that there is provided, on one side of the film used to obtain the packaging, in the position where a longitudinal pre-cut line is already present or is to be formed, a strip-shaped area which is treated so that it is not heat-sealable when it comes into contact with the film itself, the width of these strip-shaped areas being chosen so as to cover the maximum overlapping imprecision of the flaps of the section of film, due to the packaging machines.

It has in fact been possible to establish experimentally that since the two flaps of the section of film which forms the packaging are not sealed in the vicinity of the pre-cut lines, even if the two flaps of the section of film are overlapped with a certain imprecision so that the corresponding portions of the pre-cut lines do not coincide, it is nevertheless possible to obtain an easy and sharp separation of the various pairs of bottles in the packaging from the remaining part thereof, which remains firm.

Preferably the strips which are not heat-sealable are obtained by applying onto the film a substance or "varnish" (for example a nitropolyurethane varnish) which renders the film non heat-sealable with the flap thereof which overlaps the aforementioned strips. Advantageously, prior to application of the aforementioned varnish, the film is subjected to a known treatment intended to improve the adherence of the varnish. The width of the strips which are not heat-sealable will be determined in accordance with the maximum overlapping error which may be committed by the packaging machine.

As it has been possible to establish from practical tests, the novel packaging obtained with this method may be opened manually in an extremely simple manner and without the help of any tool, by simply exerting along the pre-cut lines a normal pressure with the fingers or a tearing action with the fingernails. By way of example, in a packaging containing six bottles (in which the bottles are arranged in two lines of three rows each), the surrounding film of which has formed therein two continuous pre-cut lines arranged in respective parallel vertical planes, each of which being positioned between the bottles of two adjacent rows (i.e. between two adjacent pairs of bottles), it is possible to easily separate a first pair of bottles, while the other two pairs still remain firmly packaged and may still be transported as a unit.

As it is known, the plastic film used for the packaging of the type above described is continuously produced in the form of a strap of suitable width which is ultimately wound up in reels. The operation of performing the pre-cut lines and spreading the varnish which prevents heat-sealing in the strip-shaped areas centred on the pre-cut lines will be preferably performed prior to rolling-up of the film.

The distance between the incisions which form the pre-cut lines and the width of the aforementioned strips will be chosen so as to ensure that the packaging during handling and transportation does not accidentally break.

It must be clear that, although the example of packaging for bottles has been mentioned in particular in the description above, the same type of method is applicable for obtaining the packaging for other products or containers, such as those mentioned at the beginning of this description.

BRIEF DESCRIPTION OF THE DRAWINGS

The invention will be more easily understood from the following description of a packaging for bottles obtained with the method according to the invention and of the method itself. In this description, reference will be made to the attached drawing in which.

DETAILED DESCRIPTION OF THE INVENTION

Figure 1:
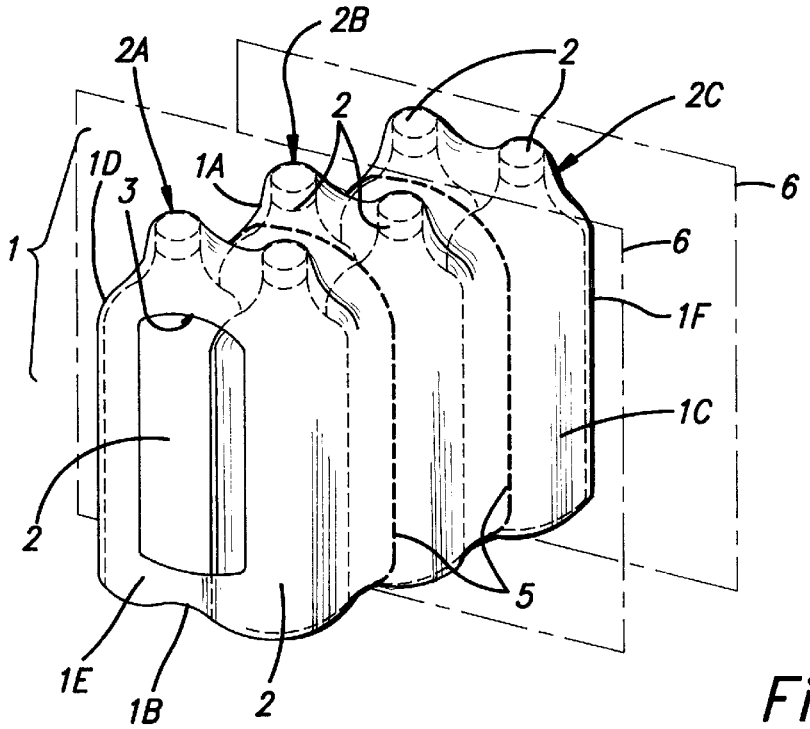
FIG. 1 shows a perspective view of a packaging containing six bottles.
Figure 2:
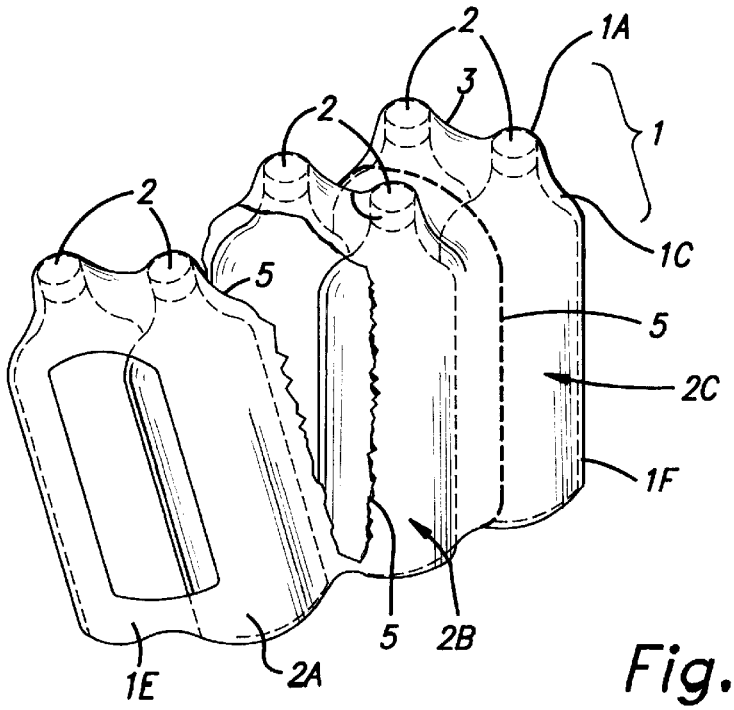
FIG. 2 shows the same packaging of FIG. 1 during the take-up of only one pair of bottles.
Figure 3:
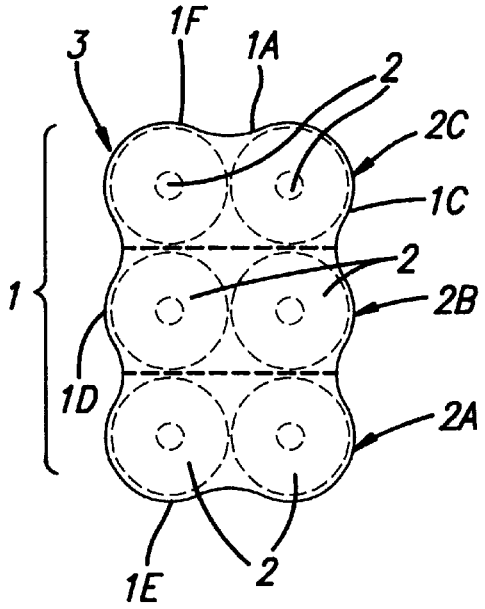
FIG. 3 shows a plan view of the packaging according to FIG. 1.

Referring now to FIGS. 1 to 3, these show a packaging 1 containing six bottles 2 arranged in an ordered manner, i.e. in two lines and three rows. The packaging 1 comprises therefore three pairs 2A, 2B, 2C of bottles arranged in succession and side by side.

The packaging 1 comprises (with reference to FIG. 1) a top side 1A, a bottom side 1B, side faces 1C, 1D, a front side 1E and a rear side 1F. The bottom side is, in the example, defined by two overlapping flaps 16 and 17 of a heat-shrinkable polyethylene film 3.

According to the invention, the packaging 1 has two pre-cut lines 5 provided in respective vertical planes 6 positioned between the rows of bottles, namely between the pairs of bottles 2A, 2B and 2B, 2C.

Figure 4:
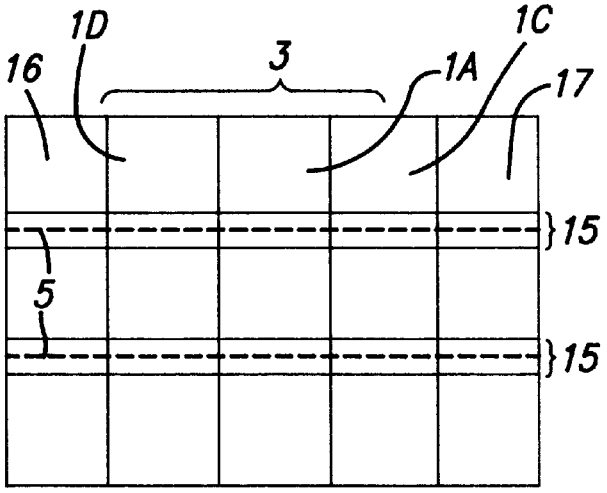
FIG. 4 is a plan view of a section of plastic film, in the unfolded position, used for obtaining the packaging shown in FIG. 1.

Each pre-cut line 5 is formed on the top surface 1A, side surfaces 1C, 1D of the packaging 1, and bottom side 1B. Each pre-cut line, moreover, may be continuous (as shown in the figures) or comprise various separate consecutive portions (all in the same plane 6). Moreover, each line may be formed by means of a plurality of incisions positioned at a suitable distance from one another, for example small equally spaced holes, or small slits (as in the figures) which may have a straight progression or also be differently shaped (for example S-shaped). In order to obtain the packaging 1 for bottles 2, use is made of the section of plastic film 3 shown in FIG. 4. The section of film 3 is wrapped in a per se known manner around the group of six bottles 2 arranged in an ordered manner and the entire assembly is placed inside an oven so as to produce both heat-shrinking of the section of film 3 and heat-sealing of the overlapping flaps of the latter, forming the base of the packaging.

As can be seen from FIG. 3, the two pre-cut lines 5 are already present since they are formed during production of the plastic film from which the section of film 3 was obtained, the lines 5 extending in the longitudinal direction of the film. As can be also seen in FIG. 3, the two pre-cut lines are centred on a corresponding strip 15 obtained by spreading on one side of the section of film 3 or printing thereon a varnish of a per se known type, suitable for preventing heat-sealing of the corresponding part of the two flaps 16 and 17 when the latter are overlapped. The strips 15 have a width sufficient to ensure that, despite the overlapping errors of the packaging machines, the pre-cut line section 5 of the flap 16 which is overlapped with the flap 17, even if it does not overlap exactly the pre-cut line section 5 of the latter, nevertheless falls within the relative strip 15.

With a packaging obtained with the method of the present invention, a user wishing to remove only one pair of bottles (for example that indicated by 2A in FIG. 2) from the packaging 1 acts manually (by applying pressure with his/her fingers or by tearing with the fingernails) on the pre-cut line 5 present between the pair 2A and the pair 2B, causing it to break or split. In this way, the portion of the section of film 3 associated with this pair is easily separated from the rest of the section of film 3 surrounding the remaining pairs of bottles 2B and 2C, despite the operational imprecision of the packaging machines and without the remaining part of the section of film 3 ceasing to firmly retain the remaining four bottles in the packaging. The packaging can therefore be easily divided into submultiples, i.e. in the case in question enclosing pairs of bottles.

It must be noted, moreover, that depending on the plastic material used to obtain the section of film 3, the incisions of each line 5 may be arranged closer together or further away from one another; in fact, in the case of bi-oriented plastic, the spaces between the incisions are wider than those provided in mono-oriented plastic, this being so in order to prevent breakage of the film along this line during the operation of heat-shrinking of the section of film 3 for obtaining the packaging or also so as to avoid the aforementioned breakage during transportation of the packaging.

What is claimed is:

1. In a method for forming a packaging for a group of containers arranged in lines and rows, which comprises:

wrapping the group of containers with a section of a heat-sealable plastic film extending in a longitudinal direction and having two end flaps which overlap and are adapted to be heat-sealed together;

forming pre-cut lines beforehand in the film, parallel to the longitudinal direction, said pre-cut lines being positioned at a distance from one another and being of a sufficient quantity to ensure that the finished packaging has the pre-cut lines substantially continuously formed along an entire perimeter of the packaging in respective vertical planes lying between two adjacent rows of containers;

the improvement which comprises:

prior to the aforementioned steps providing, on one side of the film used for obtaining the packaging, in a position where the pre-cut lines is formed, a strip-shaped area which is not heat-sealable when coming into contact with the film; each strip-shaped area having a width sufficiently wide to ensure that the pre-cut lines of one end flap will fall within the strip-shaped area of the other end flap when the group of containers is wrapped.

2. Method according to claim 1, wherein the strip-shaped areas which are not heat-sealable are obtained by applying to corresponding zones of the film, a substance which renders said zones non-heat-sealable.

3. Method according to claim 2, wherein the substance which renders said strip-shaped areas non-heat-sealable is a nitropolyurethane varnish.

4. Method according to claim 1, wherein the plastic film is heat-shrinkable.

5. Method according to claim 1, wherein the pre-cut lines are obtained by forming in the film a series of aligned incisions positioned at a distance from one another.

6. Method for forming a packaging for a group of containers arranged in lines and rows, which comprises:

providing a heat-sealable plastic film extending in a longitudinal direction, and having two end flaps;

forming pre-cut lines in the film which are parallel to the longitudinal direction;

providing, on one side of the film, in a position where a longitudinal pre-cut line is formed, is strip-shaped areas which is not heat-sealable when coming into contact with the film;

providing, on one side of the film, in a position where a longitudinal pre-cut line is formed, is strip-shaped area which is not heat-sealable when coming into contact with the film;

wrapping the group of containers with the heat-sealable plastic film such that the two end flaps overlap; and heat-sealing the two end flaps together so as to form a finished packaging having the pre-cut lines substantially continuously formed and positioned at a distance from one another, and along an entire perimeter of the packaging in respective vertical planes lying between two adjacent rows of containers;

each of the strip-shaped areas being sufficiently wide to ensure that the pre-cut lines of one end flap will fall within the strip-shaped area of the other end flap when the group of containers is wrapped.

* * * * *